US005363814A

United States Patent [19]

Daikoku

[11] Patent Number: 5,363,814

[45] Date of Patent: Nov. 15, 1994

[54] FUEL INJECTION TYPE MULTIPLE CYLINDER ENGINE UNIT

[75] Inventor: Keisuke Daikoku, Hamamatsu, Japan

[73] Assignee: Suzuki Jidosha Kogyo Kabushiki Kaisha, Japan

[21] Appl. No.: 845,029

[22] Filed: Mar. 3, 1992

Related U.S. Application Data

[63] Continuation of Ser. No. 477,294, Feb. 7, 1990, Pat. No. 5,103,777.

[30] Foreign Application Priority Data

Feb. 7, 1989 [JP] Japan ..... 1-27889
Mar. 16, 1989 [JP] Japan ..... 1-62312

[51] Int. Cl.[5] ..... F02M 35/10; F01M 3/02
[52] U.S. Cl. ..... 123/73 AD
[58] Field of Search ..... 123/73 A, 73 AD, 52 M, 123/52 MB

[56] References Cited

U.S. PATENT DOCUMENTS 4,079,717 3/1978 Shirose .
4,244,332 1/1981 Kusche et al. .
4,368,698 1/1983 Matsuo et al. .
4,475,488 10/1984 Odashima .
4,582,039 4/1986 Nishida .
4,615,305 10/1986 Matsumoto .
4,632,085 12/1986 Misawa et al. .
4,732,131 3/1988 Hensel ..... 123/516
4,763,684 8/1988 Kelch .
4,779,581 10/1988 Maier ..... 123/73 A
4,792,202 10/1988 Hensel et al. .
4,856,483 8/1989 Beavis et al. .
4,989,554 2/1991 Kushida et al. ..... 123/479
5,020,484 6/1991 Ishikawa et al. ..... 123/73 AD
5,094,196 3/1992 Tsurutani et al. ..... 123/73 A
5,140,964 8/1992 Torigai ..... 123/73 A

FOREIGN PATENT DOCUMENTS 0841189 5/1939 France ..... 123/516
1190252 4/1965 Germany ..... 123/73 AD

*Primary Examiner*—E. Rollins Cross
*Assistant Examiner*—Thomas Moulis
*Attorney, Agent, or Firm*—Bruce L. Adams; Van C. Wilks

[57] ABSTRACT

A fuel injection type multiple cylinder engine unit includes an oil lubricating device including an oil tank and the oil in the oil tank is pumped up by a pump having an oil drain side to which pipes are connected for supplying the oil near the injectors. Each of the pipe has a front nozzle portion disposed at a portion near the front fuel jetting end of the injector and the fuel and the oil independently injected in an intake device of the engine unit are atomized and mixed with suitable mixture ratio. The intake device of the engine unit is provided with a surge tank which comprises a main surge tank formed integrally with an inlet manifold and sub-surge tanks formed by forming recesses between the respective adjacent intake pipes in association with the inlet manifold. The main surge tank and the sub-surge tanks are communicated with each other to thereby increase the total inner volume of the surge tank.

11 Claims, 5 Drawing Sheets

FUEL INJECTION TYPE MULTIPLE CYLINDER ENGINE UNIT

This is a continuation of application Ser. No. 477,294 filled Feb. 7, 1990, now U.S. Pat. No. 5,103,777.

BACKGROUND OF THE INVENTION

This invention relates to a fuel injection type multiple cylinder engine unit including an oil-fuel supplying device and an intake device provided with an improved surge tank.

In a conventional technology for a two-cycle engine of an outboard motor, for example, there has been provided an engine of an outboard motor provided with a separate type oil feeding mechanism in which a fuel and a lubricating oil are supplied through different circuits. In such an outboard motor, it is difficult to return the fuel to a fuel tank in a hull body at a time when the fuel is injected. For this reason, a vapour separator is arranged in a fuel supplying system from the fuel tank and a certain amount of the fuel corresponding to an amount consumed is fed to the vapour separator by the operation of a mechanical fuel pump through a low pressure filter. The vapour separator is operatively connected at the upper portion thereof to a delivery pipe through a return pipe to return the return fuel.

On the other hand, oil is pumped up from an oil tank and fed into the vapour separator in which the fuel and oil are mixed to form a fuel mixture, which is then supplied to the delivery pipe by an electromagnetic type fuel pump through a high pressure filter and injected into the respective cylinders from the delivery pipe through injectors.

In the separate type oil-fuel feeding system described above, the drain amount of the oil pump is controlled by the rotation speed of the engine and the degree of opening of a throttle valve and it has been aimed to reduce the amount of the oil to be consumed by changing the mixing ratio to, for example, 50/1 during high load and high rotation speed operation period and 200/1 during low load and low rotation speed operation period.

However, in the conventional separate type oil-fuel feeding system of the character described above, it is required for the vapour separator to have a relatively large volume and the injectors are disposed apart from the vapour separator. Accordingly, considerable time is required to a time at which the mixing ratio of the oil-fuel mixture injected from the injectors reaches a value suitable for the actual operation with respect to the change of the operating condition of the oil-fuel supplying system. In order to obviate this defect, in the conventional technology, an excessive amount of the oil is supplied to satisfy the lubrication, thus being uneconomical in consumption of the oil. In addition, when the injector is switched "off" during the high speed operation period, the supplying of the oil stops simultaneously with the stopping of the fuel injection. This may result in the seizure of the engine.

In another aspect, it is required for the engine mounted to the outboard motor to have a compact structure, and in order to achieve this requirement, the length of the intake passage disposed in operative association with the fuel injectors is unnecessarily shortened or a surge tank has insufficient inner volume in the conventional outboard motor. Particularly, in a case where the surge tank has an insufficient inner volume, pulsations of the mixture may be caused in the intake passage. Since, in the intake passage, the mixture is generated in the respective cylinders by the fuel injectors, there may cause a case where the air-fuel ratios in the mixtures generated in the respective cylinders may be made different when the pulsations are caused.

SUMMARY OF THE INVENTION

An object of this invention is to substantially eliminate the defects or drawbacks encountered in the prior art described above and to provide a fuel injection type multiple cylinder engine unit particularly suitable for an outboard motor including an oil-fuel supplying device provided with a lubricating oil supplying means capable of achieving high response to the performance of the desired mixture ratio in response to the engine operation condition and effectively preventing the engine unit from seizing while achieving economical usage of the oil and also including an intake device capable of reducing dispersion of the air-fuel mixture ratio in the respective cylinders.

This and other objects can be achieved according to this invention by providing a fuel injection type multiple cylinder engine unit comprising an oil-fuel supplying device including a lubricating oil supplying means and an intake device arranged in operative association with the oil-fuel supplying device and including an intake pipe means, the oil-fuel supplying device comprising a vapour separator connected to a fuel tank disposed external to the engine unit through a duct, a delivery pipe connected to the vapour separator through a duct, an injector means provided for the delivery pipe, the injector means comprising a plurality of injectors corresponding to the numbers of the cylinders, each of the injectors having a front end through which fuel is injected into the intake device, an oil tank, an oil pump for pumping up oil from the oil tank, the oil pump being provided with an oil intake side and an oil discharge side, and an oil feeding pipe means comprising a plurality of pipes corresponding to the numbers of cylinders, each of the oil feeding pipes having one base end connected to the discharge side of the oil pump and the other front end opened at a portion near the front end of a corresponding one of the injectors.

The intake device of the fuel injection type multiple cylinder engine unit comprises an intake pipe means comprising a plurality of intake pipes corresponding to the numbers of the cylinders, an inlet manifold coupled with the respective intake pipes in communication therewith, a crank case coupled with the intake pipes through a lead valve holder so as to communicate with each other, a cylinder block coupled with the crank case and including cylinders and pistons, and a surge tank means disposed in association with the intake pipes, the surge tank means comprising a main surge tank integrally formed with the inlet manifold and sub-surge tanks integrally formed with the inlet manifold and the intake pipes between respective adjacent intake pipes, each of the sub-surge tanks communicating with the main surge tank through communication holes.

According to the structure of the fuel injection type multiple cylinder engine unit of character described above, only the fuel is injected and atomized into the intake device and the oil is independently drained into the intake device through pipes without passing the vapour separator and the drained oil is atomized in the intake device together with the atomization of a fuel with the predetermined mixture ratio. The mixture is then injected into the respective cylinders of the engine unit. Accordingly, the mixture ratio of the oil with respect to the fuel can be adjusted by changing the drain amount of the oil in response to the change of the engine operation condition, whereby the fuel with a desired mixture ratio can be injected with substantially no time lag.

In another aspect, the intake device is provided with the surge tank composed of the main surge tank and the sub-surge tanks formed by utilizing the space between the location of the intake pipes and the inlet manifold, whereby the inner volume of the surge tank is totally increased, thus significantly reducing the pulsation of the intake air. Accordingly, the inner pressures of the respective intake pipes can be made stable and the dispersion of the air-fuel mixture ratios in the respective cylinders can be substantially eliminated.

DESCRIPTION OF THE PREFERRED EMBODIMENTS

Figure 1:
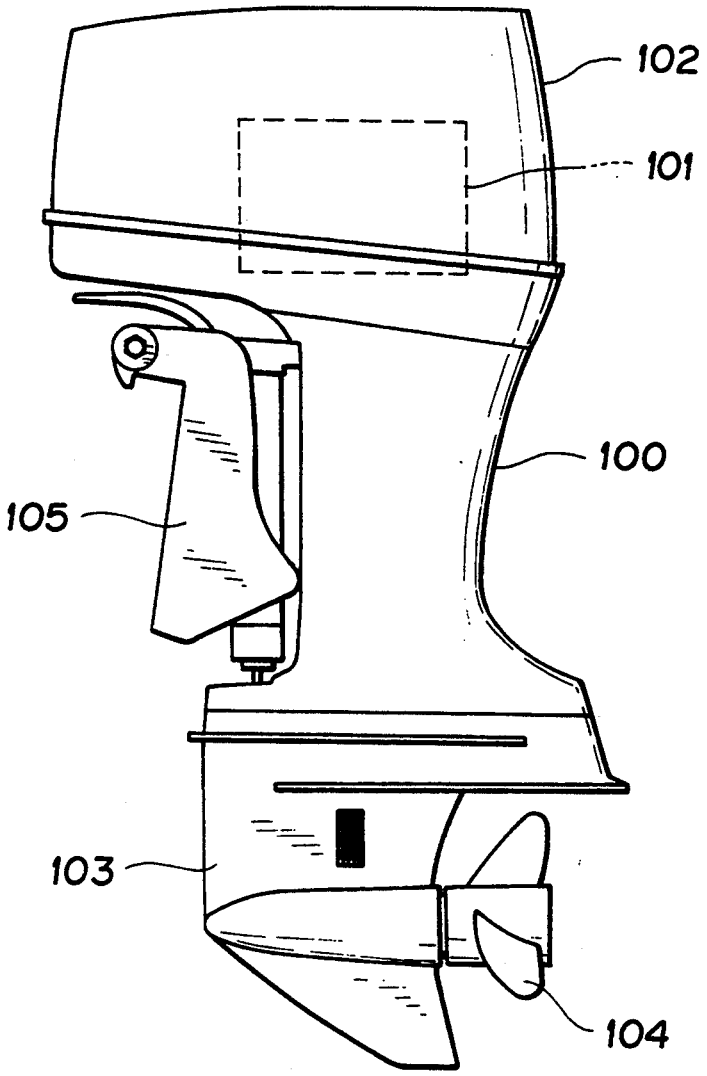
FIG. 1 is a brief side view of one example of an outboard motor equipped with an engine unit according to this invention.

FIG. 1 is a brief sectional view of a fuel injection type two-cycle three-cylinder engine to which embodiments according to this invention are applicable.

Referring to FIG. 1, an outboard motor unit comprises a drive shaft housing 100 and an engine 101 mounted above the housing 100 and covered by an engine cover 102. A gear case 103 is mounted to the lower portion of the drive shaft housing 100 and a propeller 104 is secured to the gear case 103 through a propeller shaft, not shown. The driving force of the engine 101 is transmitted to the propeller shaft through a power transmission mechanism accommodated in the drive shaft housing 100 and the gear case 103 to thereby drive the propeller 104 to propel the hull. Reference numeral 105 designates a clamp bracket for attaching the outboard motor unit.

Figure 2:
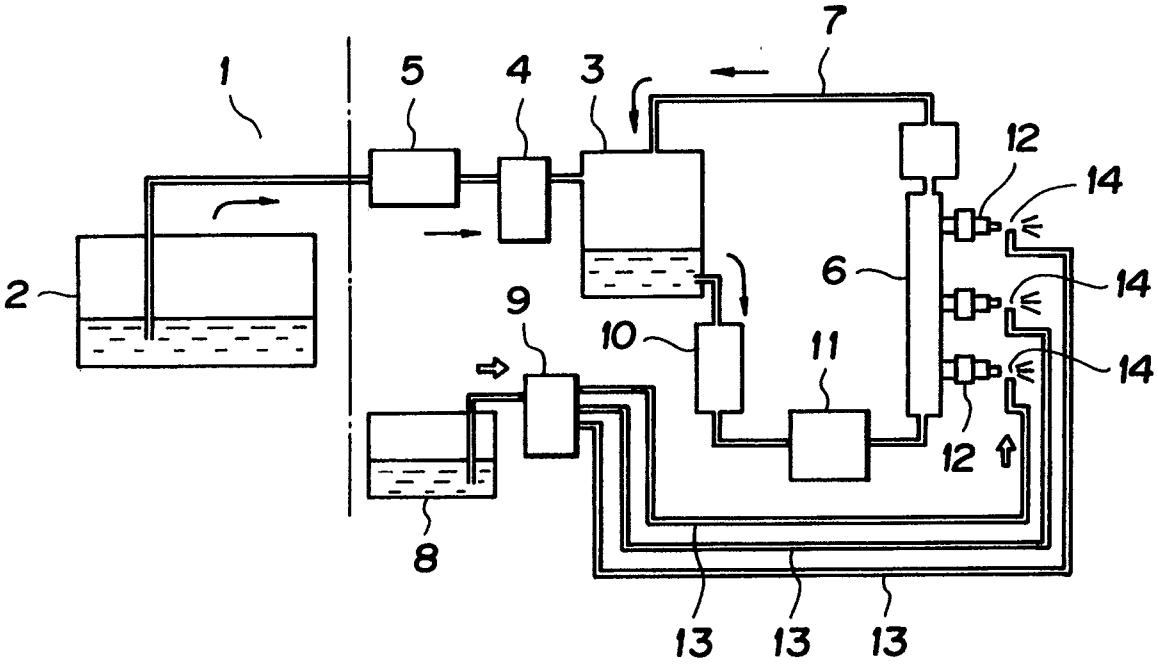
FIG. 2 is a schematic view showing the structure of an oil-fuel supplying device of the engine unit according to this invention.

FIG. 2 is a schematic view showing the structure of an oil-fuel supplying device of the engine, such as designated by reference numeral 101 in FIG. 1, according to this invention. Referring to FIG. 2, a fuel is supplied to a vapour separator 3 from a fuel tank 2 disposed on the side of a hull 1 through a mechanical fuel pump 5 and a low pressure filter 4. The vapour separator 3 is connected to a delivery pipe 6 through an electromagnetic fuel pump 10 and a high pressure filter 11. A plurality of fuel injectors 12, three in the illustrated embodiment of three-cylinder engine, are provided for the delivery pipe 6 to inject the fuel into the respective cylinders. The delivery pipe 6 and the vapour separator 3 are connected to a return pipe 7 having one end connected to the upper portion of the vapour separator 3 through which the fuel returns to the vapour separator 3.

On the other hand, an oil is pumped up from an oil tank 8 disposed on the side of the hull 1 by means of an oil pump 9. A plurality, corresponding in number to the numbers of the fuel injectors 12, of oil supplying pipes 13 are connected at one ends thereof on the drain side of the oil tank 8 and the other ends of the respective pipes 13 are opened near the corresponding injectors 12.

Figure 3:
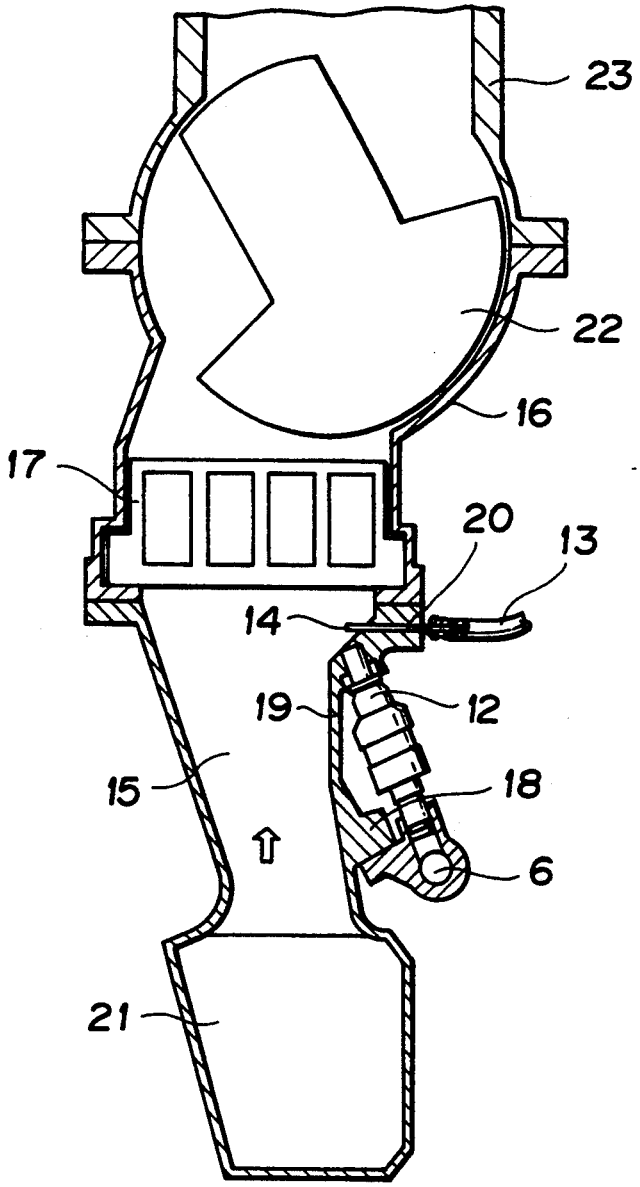
FIG. 3 is an elevational section of an intake device in association with the device shown in FIG. 1 according to this invention.

FIG. 3 represents a structure of the injector 12 and the associated elements of the engine unit 101, in which an intake pipe 15 is connected to a crank chamber 16 via a lead valve 17 disposed at the connecting portion between the intake pipe 15 and the crank chamber 16. The delivery pipe 6 is secured to a mounting eye 18 formed on the outer surface of the intake pipe 15. The injector 12 has a front nozzle portion penetrating the outer wall 19 of the intake pipe 15 and is opened to the lead valve 17.

The oil passage pipe 13 has an opened front end 14 formed as a nozzle member 20 which extends so as to penetrate the outer wall of the intake pipe 15 m and the front end of the nozzle member 20 is opened in a horizontal direction at a portion just before the front nozzle portion of the injector 12. In FIG. 3, reference numeral 21 designates a surge tank and numerals 22 and 23 designate a crank shaft and a cylinder, respectively.

According to the structure described above, the fuel pumped from the vapour separator 3 by means of the fuel tank 10 is supplied to the delivery pipe 6 through the high pressure filter 11 and injected through the injectors 12. At this moment, the fuel is atomized. On the other hand, the oil pumped up from the oil tank 8 by means of the oil pump 9 is supplied through the oil passage pipes 13 and drained just before the injectors through the opened ends of the nozzle members 20 disposed at the front ends of the oil passage pipes 13.

As described, the oil supplied at a portion at which the fuel is atomized is also atomized and mixed with the fuel and the thus formed oil-fuel mixture is supplied to a combustion chamber of the engine unit.

Accordingly, when the high load rotation operation or low load rotation operation of the engine is changed, the oil supply amount can be controlled in response to the fuel supply amount so that the oil supply amount can be instantaneously responsive to the change of the engine operation, thus highly improving the response characteristic.

In a modification of the embodiment of this invention, the fuel injecting position may be made to the rear-stream side of the lead valve 17 and multi-point injection and single-point injection type may be also applicable.

Figure 4:
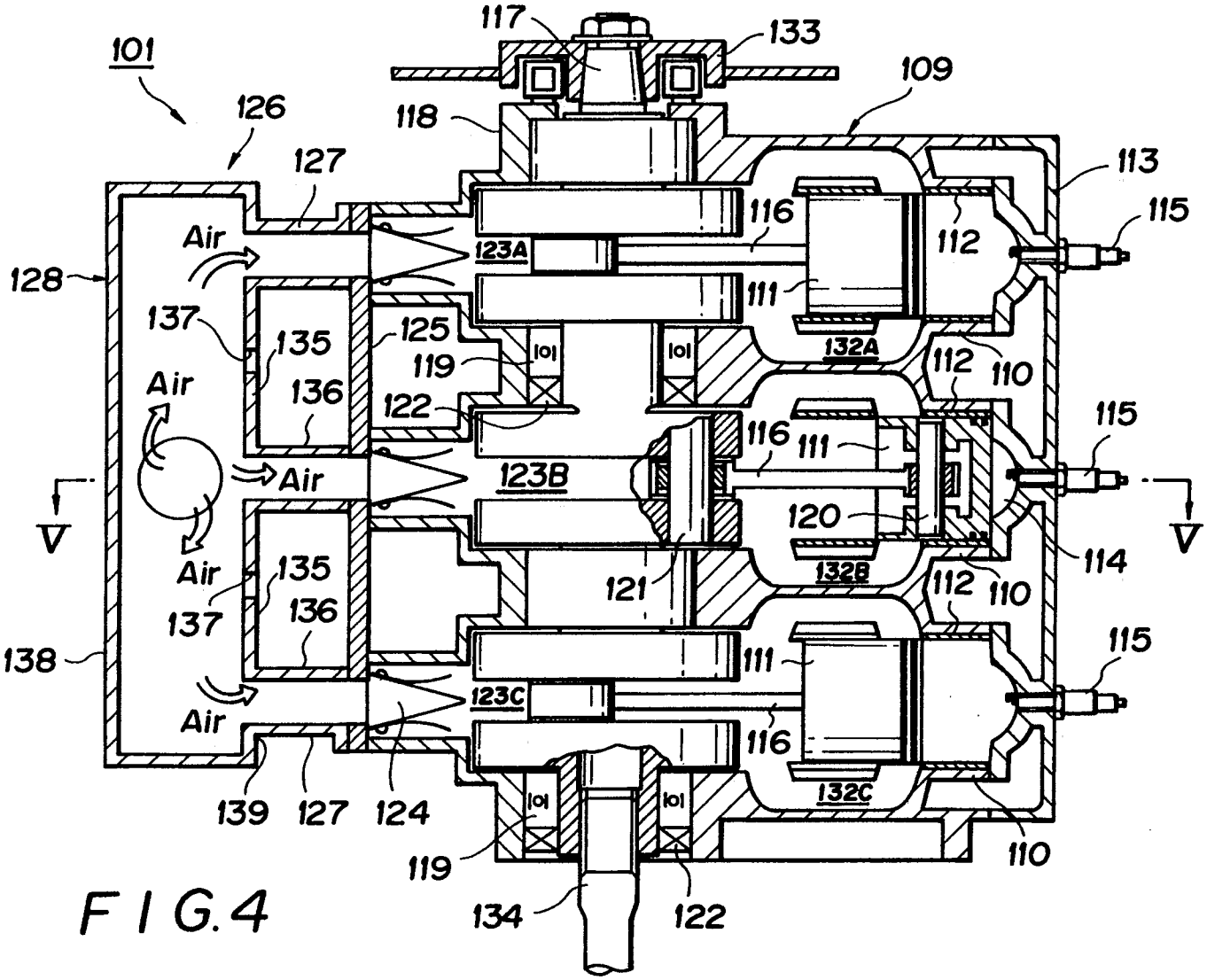
FIG. 4 is a sectional view of a three-cylinder engine unit including an intake device according to this invention.

The engine 101 shown in FIG. 1 is constructed as a two-cycle multiple cylinder type vertical crank engine of fuel injection type provided with fuel injectors for the intake pipe as shown in detail in FIG. 4.

Referring to FIG. 4, the engine 101 is provided with a cylinder block 109 into which three cylinders 110 are arranged horizontally in the illustration. A piston 111 is fitted into each of the cylinders 110 to be reciprocatingly slidable therein and a cylinder sleeve 112 is bonded to the inner surface of the cylinder 110 to reduce the friction between the cylinder 110 and the piston 111. A cylinder head 113 is firmly engaged with the cylinder block 109 to form combustion chambers 114 between the cylinder head 113 and the respective pistons 111. Ignition plugs 115 are disposed in the cylinder head 113.

The pistons 111 are coupled with a crank chart 117 through connecting rods 116, respectively. The crank shaft 117 is supported to be rotatable by the cylinder block 109 and a crank case 119 via a crank shaft bearing 119. The connecting rod 116 is provided with a small diametered end portion which is journaled to the piston 111 by a piston pin 120 and with a large diametered end portion which is journaled to the crank shaft 117 by a crank pin 121. The linear reciprocating movement of the piston 111 is converted into a rotation movement of the crank shaft 117 by way of the connecting rod 116.

In the illustration, the crank shaft 117 is vertically arranged and sealed by crank shaft sealing members 122 mounted to the respective cylinders 110, whereby crank chambers 123A, 123B and 123C are formed respectively in each cylinder by the crank case 118, the cylinder block 109 and the crank shaft sealing member 122. Lead valves 124 are arranged in intake passages communicating with the crank chambers 123A, 123B and 123C, respectively. The lead valves 124 are preliminarily assembled with a lead valve holder 125 and then fitted into the respective intake passages of the crank case 118.

Figure 5:
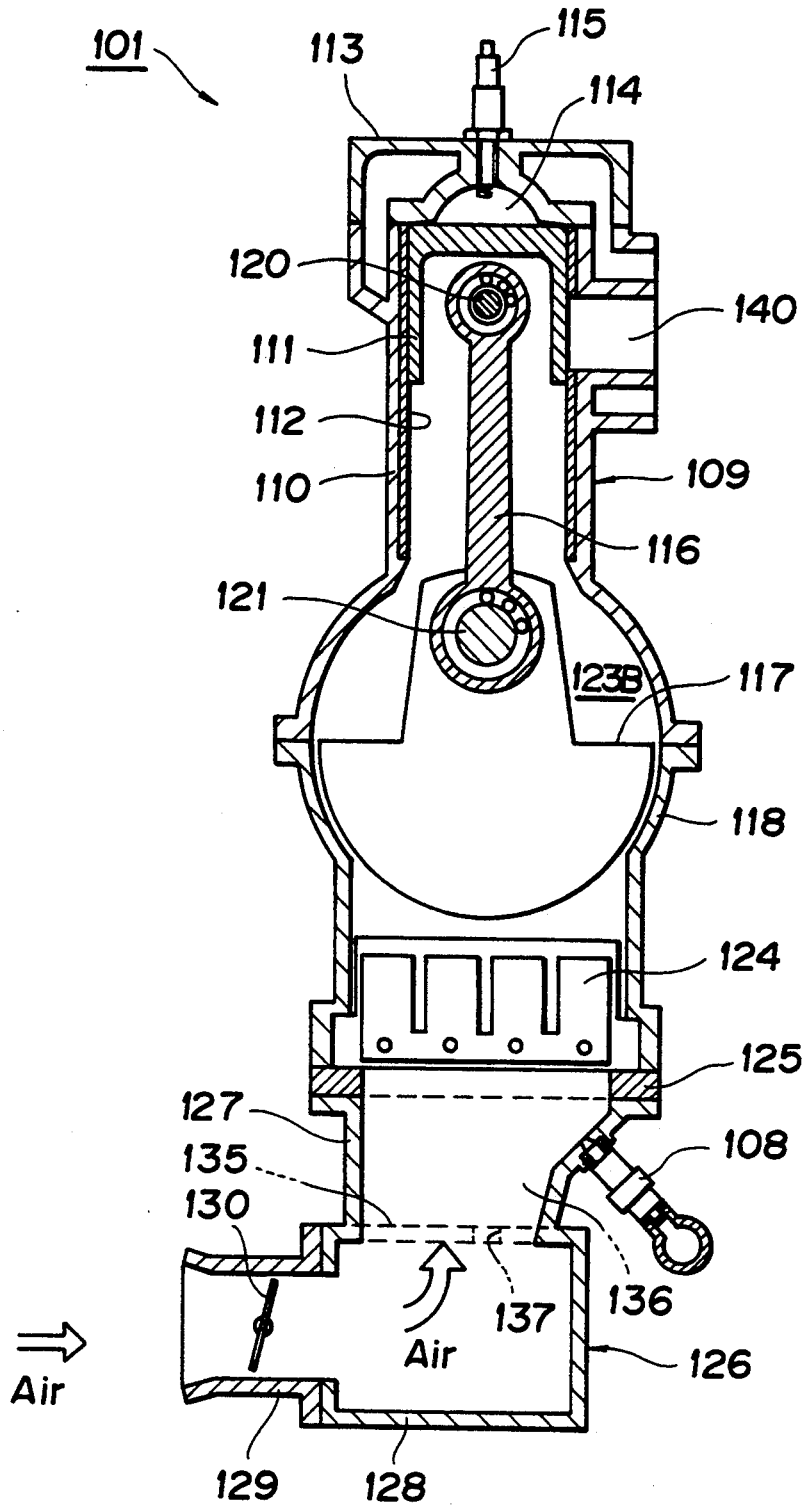
FIG. 5 is a sectional view taken along the line V—V shown in FIG. 4.

The inlet manifold 126 is formed by three intake pipes 127 and one main surge tank 128 which are integrated. The inlet manifold 126 is coupled with the crank case 118 so that the intake pipes 127 are in registration with the intake passages, respectively. With the main surge tank 128, as shown in FIG. 5, is coupled a throttle body 129 in which a throttle valve 130 is rotatably supported. According to this construction, the intake air is sucked by a negative pressure caused by the reciprocating displacement of the piston 111 and induced into the surge tank 128 with a flow rate controlled by the throttle valve 130. The pulsation of the air is reduced in the surge tank 128 and then introduced into the respective intake pipes 127.

Fuel injectors 108 are disposed in the respective intake pipes 127 and a delivery pipe 131 is connected to the respective fuel injectors 108 so that the fuel pressurized by a fuel pump, not shown, is distributed to the respective fuel injectors 108. Thus, the fuel is atomized in the intake pipes 127 and air-fuel mixture is produced.

The mixture, as shown in FIG. 4, is introduced into the respective crank chambers 123A, 123B and 123C through the intake pipes 127 and the lead valve 124. The cylinder block 109 connected to the crank case 118 is provided with scavenge passages 132A, 132B and 132C for the respective cylinders 110 so as to communicate with the corresponding crank chambers 123A, 123B and 123C and the cylinders 110. Thus, the mixture introduced into the respective crank chambers 123A, 123B and 123C is guided into the respective cylinders 110 via the scavenge passages 132A, 132B and 132C.

The crank shaft 117 has one end to which a flywheel magnet 133 is mounted and the other end to which a drive shaft 134 is coupled. A discharge passage 140 is formed in the cylinder block 109 as shown in FIG. 5.

A recessed portion 135 is formed between the intake pipes 127 of the inlet manifold 126, and a sub-surge tank 136 is formed by covering the recessed portion with a lead valve holder 125. The sub-surge tank 136 communicates with the main surge tank 128 through a communication hole 137 formed in the bottom of the recessed portion 135.

As described above, with respect to the two-cycle engine, since the scavenge passages 132A, 132B and 132C are formed between the cylinders 110 of the cylinder block 109, it is difficult to considerably reduce the layout pitches of the respective cylinders 110. For this reason, the layout pitches of the respective intake pipes 127 with respect to the inlet manifold 126 can be made relatively large and accordingly the sub-surge tank 136 has a relatively large volume. In thus manner, the surge tank is constituted by the main surge tank 128 and the sub-surge tank 136.

According to the described embodiment, the surge tank is constituted by the main surge tank 128 and the sub-surge tank 136 having the totally increased inner volume, so that, in a case where the D-Jetronic controlling system (carrying out the control in response to the relationship of rotation number and negative pressure of intake pipe) is adopted as a fuel injection controlling system, the variations due to the negative pressures in the respective intake pipes 127 can be made significantly small and, hence, the pulsation of the intake air can be remarkably reduced. Accordingly, the inner pressures in the intake pipes 127 can be made stable and the air-fuel ratios of the mixtures generated in the intake pipes 127 are made substantially equal with respect to the respective cylinders 110 even with respect to a small sized multiple cylinder engine. Therefore, a multiple cylinder concurrent injection system can be utilized by means of the fuel injectors 108.

Moreover, in a case where the distance between the front surface 138 of the inlet manifold 126 and the crank shaft 117 is limited by a matter of layout, the inner volume of the main surge tank 128 may be reduced by approaching the rear surface 139 of the inlet manifold 126 to the front surface 138 thereof to elongate the intake pipes 127. This can be achieved only by the provision of the sub-surge tank 136 having relatively a large inner volume. In general, in the arrangement of the intake pipes each having a relatively short length, there will cause a spitting phenomenon in which the fuel jetted and atomized in the intake pipe 127 of one of the cylinders 110 on the upstream side of the lead valve 124 flows into the intake pipe 127 of the other one of the cylinders 110 due to the pulsation of the intake air and hence the air-fuel ratios of the mixtures in the respective cylinders 110 are made different. This adverse spitting phenomenon can be eliminated according to the embodiment of this invention in which the intake pipes 127 can be constructed so as to have long lengths.

Furthermore, in a case where $\alpha$-N control system in which the fuel injection is controlled by the throttle angle $\alpha$ and the rotation number N is adopted as well as the D-Jetronic control system as the fuel injection control system, the sub-surge tank 136 acts as a resonance chamber, so that the intake noise can be significantly reduced. With the reduction of the intake noise, the size of the communication hole 137 and the inner volume of the sub-surge tank 136 can be selectively designed in accordance with the frequency of the intake noise.

The location of the sub-surge tank 136 makes stable the inner pressure in the intake pipe 127, so that the fuel injection control can be achieved with high accuracy by means of the fuel injectors 108.

Furthermore, the sub-surge tank 136 can be formed only by utilizing the recessed portion 135 between the intake pipes 127 at the inlet manifold 126, so that the structure is not made complicated. In addition, the sub-surge tank 136 may be formed by applying the crank case 118 in place of the lead valve holder 125.

In the foregoing, the preferred embodiment of this invention was described with reference to the two-cycle engine, but a modification may be applicable to the intake pipes and the surge tank of a four-cycle engine.

What is claimed is:

1. An internal combustion engine, comprising: at least one cylinder; a piston mounted to undergo reciprocating movement in the cylinder and defining therewith a combustion chamber; an intake pipe in communication with the cylinder for admitting air into the combustion chamber; fuel injecting means for injecting fuel into the intake pipe for mixing with air drawn in through the intake pipe to form an air-fuel mixture, the fuel injecting means being located to inject the fuel into the intake pipe from a point on the inner sidewall of the intake pipe so that the fuel is injected in an oblique direction with respect to the direction of primary air flow through the intake pipe at the cross-section thereof where the fuel is injected; and oil feeding means for feeding oil into the intake pipe in the region where the fuel is injected to effect atomization of the oil in the intake pipe to form an oil-fuel mixture.

2. An internal combustion engine according to claim 1; wherein the oil feeding means includes on oil passage opening into the intake pipe for directing the oil into the intake pipe so that the oil intersects with the fuel injected by the fuel injecting means.

3. An internal combustion engine according to claim 2; wherein the oil feeding means includes an oil passage pipe which defines the oil passage, the oil passage pipe projecting into the intake pipe for feeding the oil directly into the path of the fuel injected by the fuel injecting means.

4. An internal combustion engine according to claim 2; wherein the fuel injecting means includes a fuel injector opening into the intake pipe for injecting the fuel into the intake pipe in a direction toward the cylinder.

5. An internal combustion engine according to claim 1; wherein the oil feeding means includes means for controlling the amount of oil fed into the intake pipe in accordance with engine operating conditions.

6. An internal combustion engine according to claim 5; wherein the means for controlling the amount of oil comprises a pump driven by the engine for feeding oil into the intake pipe.

7. An internal combustion engine according to claim 1; including a plurality of cylinders each having a piston disposed therein to undergo reciprocating movement to define respective combustion chambers; an inlet manifold for intaking air; a plurality of intake pipes having upstream ends in communication with the inlet manifold and downstream ends in communication with respective ones of the cylinders; wherein the fuel injecting means includes means for injecting fuel into respective ones of the intake pipes; and wherein the oil feeding means includes means for feeding oil into respective ones of the intake pipes in the rejoins where the fuel is injected to effect atomization of the oil in the intake pipes to form an oil-fuel mixture.

8. An internal combustion engine according to claim 7; including means for controlling the amount of oil fed into the intake pipes in accordance with engine operating conditions.

9. An internal combustion engine according to claim 8; wherein the means for controlling the amount of oil comprises a pump driven by the engine for feeding oil into the intake pipes.

10. An internal combustion engine according to claim 1; wherein the fuel injecting means opens at the inner sidewall of the intake pipe.

11. An internal combustion engine according to claim 10; wherein the fuel injecting means terminates substantially flush with the inner sidewall of the intake pipe.

* * * * *